US007205950B2

(12) United States Patent
Imai et al.

(10) Patent No.: US 7,205,950 B2
(45) Date of Patent: Apr. 17, 2007

(54) RADIO WAVE LENS ANTENNA

(75) Inventors: Katsuyuki Imai, Osaka (JP); Masatoshi Kuroda, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/559,574

(22) PCT Filed: Jun. 2, 2004

(86) PCT No.: PCT/JP2004/007613

§ 371 (c)(1),
(2), (4) Date: Dec. 5, 2005

(87) PCT Pub. No.: WO2004/109856

PCT Pub. Date: Dec. 16, 2004

(65) Prior Publication Data

US 2006/0132380 A1 Jun. 22, 2006

(30) Foreign Application Priority Data

Jun. 5, 2003 (JP) ..... 2003-161128
May 26, 2004 (JP) ..... 2004-156002

(51) Int. Cl.
*H01Q 13/00* (2006.01)

(52) U.S. Cl. ..... 343/785; 343/776; 343/911 L

(58) Field of Classification Search ..... 343/911 L, 343/911 R, 753, 754, 755, 786, 785, 776
See application file for complete search history.

(56) References Cited

U.S. PATENT DOCUMENTS 4,468,672 A 8/1984 Dragone
4,482,899 A 11/1984 Dragone
6,424,319 B2 * 7/2002 Ebling et al. ..... 343/911 L
6,580,400 B2 6/2003 Sato et al.
2005/0219126 A1 * 10/2005 Rebeiz et al. ..... 343/700 MS

FOREIGN PATENT DOCUMENTS

| | | |
|---|---|---|
| JP | 53-146557 | 12/1978 |
| JP | 54-004049 | 1/1979 |
| JP | 57-55321 | 11/1982 |
| JP | 58-501851 | 10/1983 |
| JP | 59-094902 | 5/1984 |
| JP | 04-074005 | 3/1992 |
| JP | 04-369905 | 12/1992 |
| JP | 05-308220 | 11/1993 |
| JP | 6-504659 | 6/1994 |
| JP | 10-163730 | 6/1998 |
| JP | 11-027037 | 1/1999 |
| JP | 2001-068919 A | 3/2001 |

(Continued)

OTHER PUBLICATIONS

Japanese Office Action for Counterpart Japanese application No. 2004-156002, Mailing date of Jun. 27, 2006.

*Primary Examiner*—Hoanganh Le
(74) *Attorney, Agent, or Firm*—McDermott Will & Emery LLP

(57) ABSTRACT

A multi-beam lens antenna for individual communication with communication satellites spaced at small elongations. The multi-beam antenna comprises primary feeds 3 each of which is composed of a waveguide having an opening at the end and a dielectric body 6 disposed at the end, a hemispherical Luneberg radio wave lens, and a reflective plate attached to the circular opening of the hemispherical radio wave lens and adapted for reflecting a radio wave incoming from the sky or emitted toward a target. The waveguides are preferably rectangular waveguides 4 rather than circular waveguides 5. The dielectric bodies 6 are preferably tapered.

20 Claims, 13 Drawing Sheets

FOREIGN PATENT DOCUMENTS

| | | | |
|---|---|---|---|
| JP | 3195923 | | 6/2001 |
| JP | 2001-284950 | A | 10/2001 |
| JP | 2002-232230 | A | 8/2002 |
| JP | 2003-110349 | | 4/2003 |
| JP | 2004-304659 | A | 10/2004 |
| WO | WO 83/01711 | | 5/1983 |
| WO | WO 92/13373 | | 8/1992 |
| WO | WO 03/030303 | A1 | 4/2003 |

* cited by examiner

RADIO WAVE LENS ANTENNA

RELATED APPLICATION

This application is the U.S. National Phase under 35 U.S.C. § 371 of International Application No. PCT/JP2004/007613, filed on Jun. 2, 2004, which in turn claims the benefit of Japanese Application No. 2003-161128, filed on Jun. 5, 2003, and Japanese Application No. 2004-156002, filed on May 26, 2004, the disclosures of which Applications are incorporated by reference herein.

1. Field of the Invention

The present invention relates to a radio wave lens antenna for wireless communications, which is constructed by combining a spherical or hemispherical Luneberg radio wave lens for focusing radio wave beam with compact primary feeds.

2. Background of the Invention

FIG. 1 schematically shows an antenna using a hemispherical Luneberg radio wave lens. In FIG. 1, reference numeral 1 denotes a hemispherical Luneberg radio wave lens (hereinafter, referred to as 'radio wave lens') for focusing radio wave beam. Reference numeral 2 indicates a reflective plate attached to the half-cut flat surface of the sphere of the radio wave lens 1 to reflect a radio wave incoming from the sky or radiated toward a target, while reference numerical 3 designates a primary feed for transmitting and receiving a radio wave. The primary feed 3 is supported by an arch-type arm or the like (not shown) and is configured to be positioned at an arbitrary radio wave focus point of the radio wave lens 1.

In case of receiving a radio wave in this radio wave lens antenna, for example, a radio wave A incoming from a certain direction reaches the reflective plate 2, after the propagation direction thereof is bent by the radio wave lens 1, and then is reflected by the reflective plate 2 to be focused at an opposite side of the lens with respect to the center of the lens as shown in FIG. 1. Thus, the focused wave can be received by the primary feed 3. This means that radio waves from random directions above the reflective plate 2 can be received; in other words, an arbitrary point of the hemisphere of the radio wave lens 1 can be a focal point.

On the other hand, in case of transmission, a reversibility of the process described above can be applied.

Further, although the focal point is shown to be on the surface of the lens in FIG. 1, in reality, the focal point is normally formed a slightly outside the lens surface (generally varied in the range from 0 mm to 100 mm).

Considering the above characteristics, radio waves can be independently received or transmitted from or to a plurality of (N) geostationary satellites which reside in a plane including the equator, by preparing a plurality of (N) primary feeds 3 and installing some at focal points of the respective geostationary satellites. It is a great advantage of the present radio wave lens antenna that one radio wave lens can communicate with N satellites.

However, in order to use the radio wave lens antenna as a practical multi-beam lens antenna, the problems described below should be solved.

SUMMARY OF THE INVENTION

Problems to be Solved by the Invention

For example, in Japan, since communication satellites are located adjacent to each other at every 4 degrees interval (2 degrees in foreign countries), the elongation between those communication satellites (abbreviated to 'CS') viewed from the surface of the earth is about 4.4 degrees (2.2 degrees in foreign countries). To take advantage of the radio wave lens antenna to independently communicate with the respective satellites separated by the interval of 4.4 degrees, it is required to align primary feeds side by side at the respective focal points near the surface of the radio wave lens at the interval of 4.4 degrees. Further on this requirement, for example, if focal points of a lens antenna with a radius of 200 mm are at positions 50 mm away from the surface, the straight line distance between the adjacent primary feeds can be calculated as $2\times(200+50)\times(\sin(4.4/2))$ to be about 19.2 mm. To meet this requirement, small primary feeds are needed.

Further, to use a radio wave of a same frequency, it is necessary for the adjacent satellites separated from each other at the interval of 4.4 degrees to communicate independently. To achieve this, it is required that interference noises from other satellites be small. In other words, in the antenna pattern of the entire lens antenna by each primary feed, the level of a signal (sidelobe which becomes noise) from a direction deviated by 4.4 degrees (4.4 degrees elongated direction) must be small enough compared to the level of the signal from the main direction (main lobe).

FIG. 14 represents an example of the antenna pattern of an antenna. M denotes a main lobe and signals S other than the main lobe are sidelobes.

Since, near the communication satellites, there exist not only communication satellites which are 4.4 degrees away, but also many other satellites, ITU Recommendation (ITU-R B.O. 1213), for example, provides that it is desirable that the sidelobe levels should be lower than that given by an envelope represented by the following formula (depicted by a dotted line in FIG. 14).

$$29-25\log\Theta\,\mathrm{dBi}\ (\Theta\text{: elongation[degree]})$$

Although various methods to lower the sidelobe levels of an antenna have been reported, it is generally known that it can be achieved by producing a tapered opening distribution (mainly, amplitude distribution) of the antenna.

In order to realize this by using a lens antenna, the tapered power (amplitude) can be achieved at the radiation opening surface of the lens antenna, by having the power supplied to the center portion of the lens high and by gradually reducing the power while approaching the surface of the lens to thereby make an antenna pattern of the single primary feed narrow. Hereinafter, narrowing the antenna pattern is defined by using 3 dB power width (full width at half maximum) of the antenna pattern. In other words, making the antenna pattern narrow is rephrased as being of a narrow full width at half maximum or narrowing its full width at half maximum.

FIGS. 2A and 2B show the comparative antenna patterns in cases of a uniform amplitude distribution and a tapered amplitude distribution. As shown FIG. 2A, if the amplitude distribution is uniform, the levels of the sidelobes S compared to that of the main lobe M become relatively high, whereas the sidelobes S are decreased if the amplitude distribution is tapered as shown in FIG. 2B.

However, it is theoretically proved that, in general, the larger the opening of the antenna, the narrower the full width at half maximum, on the other hand, the smaller the opening of the antenna, the wider the full width at half maximum thereof. FIG. 14 represents the antenna pattern of a lens antenna in the case of receiving a radio wave by a primary feed having wide full width at half maximum, where sidelobes S exceed the desirable envelope.

If the opening is made smaller to make the primary feed smaller, the sidelobe levels of the lens antenna become higher. On the other hand, in order to make the full width at half maximum narrower to lower the sidelobes, the primary feed becomes larger. Therefore, making the primary feed compact and lowering the sidelobes of the lens antenna are not compatible with each other.

Meanwhile, a focal length of conventional parabolic antenna is greater than that of the lens antenna Therefore, the primary feed can be designed without restriction on that account and a circular horn antenna (conical horn antenna whose opening size is over 30 mm) is generally used. However, the parabolic antenna cannot communicate with a plurality of satellites. Further, there is a problem that the parabolic antenna is bulky, because parts such as a supporting arm or the like of the primary feed become bigger to accommodate the longer focal length.

It is, therefore, an object of the present invention to provide an antenna using a Luneberg radio wave lens which can keep sidelobes under the desirable envelope level and at the same time make the size of primary feeds small enough to cope with satellites spaced at small elongations. If the object is achieved, a compact and high performance multi-beam antenna can be realized.

Further, if compact primary feeds are arranged adjacently to each other, the so-called mutual coupling phenomena occurs and the single characteristic (antenna pattern) of the neighboring primary feeds changes significantly, thereby resulting in deterioration of the performance of antennas. Therefore, it is important to reduce the effect of mutual coupling phenomena as much as possible and satisfying the requirement is also an object of the invention.

[Means to Achieve the Objects]

In order to achieve the above objects, the present invention provides a radio wave lens antenna which is constructed by combining a primary feed with a hemispherical or spherical Luneberg radio wave lens wherein a reflective plate is attached to the half-cut surface of the sphere, the primary feed being formed of a dielectric-loaded waveguide antenna (dielectric-loaded feed) in which a dielectric body is loaded at an end opening of a waveguide. Although the waveguide constituting in the primary feed can be tapered to have a slightly wider periphery in consideration of the insertion of dielectric body or die-cutting in production, it is basically a straight tube and differs in shape from the waveguide used for a horn antenna.

The dielectric-loaded waveguide antenna employed in this radio wave lens antenna is preferably a rectangular waveguide loaded with a dielectric body at an end opening (dielectric-loaded rectangular waveguide antenna) rather than a circular waveguide or a waveguide having an elliptical cross section. The term rectangular waveguide used herein basically indicates a tube with a square cross section. However, it can have a rectangular cross section to adjust the antenna patterns of an E-plane and an H-plane. It is also preferable that the dielectric-loaded waveguide antenna is a choke structure antenna with an annular groove around the front surface the waveguide.

A dielectric body loaded at the end opening of the waveguide can be of a column shape. The desirable shapes of the dielectric body are as follows:

Having the dielectric body protruded from the end of a waveguide and make the protrusion be of a taper shape having a thinned end;

Making the end of the dielectric body be of a non-rotational symmetrical shape by placing the center of the end of the dielectric body to be at a position located off the extension of the waveguide's center axis;

Removing a part of the outer periphery of the protrusion of the dielectric body projected forward from the waveguide along the plane of a direction intersecting the cross section of the waveguide (cross section normal to the axis);

In the plane including the cross section of the protrusion, making the dimension of the protrusion of the dielectric body projected forward from the waveguide smaller in the disposed direction of the primary feeds than in the direction normal to the disposed direction of the primary feeds;

Making flat or round the end of the dielectric body protruded from the waveguide by cutting out the end of the dielectric body.

Further, the shape of the dielectric body need not be the same as that of the waveguide. Namely, a convex lens-shaped dielectric body can be loaded at the end opening of the waveguide.

[Effects of the Invention]

In the primary feed (dielectric-loaded waveguide antenna) employed in the radio wave lens antenna in accordance with the present invention, the effect that the power supplied to the center portion of the lens is high and the power is gradually reduced while approaching the surface of the lens is enhanced by a function of the dielectric body loaded at the end opening of the waveguide. Therefore, the full width at half maximum can be made narrow without recourse to a large antenna opening.

Furthermore, in a rectangular waveguide, the lowest frequency (cutoff frequency) of a radio wave that can propagate through the waveguide is lower compared to that of a same size circular waveguide. Thus, the rectangular waveguide can ensure a desirable frequency band with a smaller tube than the circular waveguide. Therefore, the primary feed formed of a dielectric-loaded rectangular waveguide antenna can satisfy a higher degree of compactness required for a primary feed combined with the radio wave lens.

As discussed above, since the radio wave lens antenna in accordance with the present invention is constructed by combining the primary feed including the dielectric-loaded waveguide antenna and the hemispherical Luneberg radio wave lens, compactness of the primary feed can be achieved while reducing sidelobes of the lens antenna. Thus, it is possible to realize an efficient multi-beam antenna which communicates with a plurality of satellites spaced at small elongations.

Further, by having the dielectric body protruded from the waveguide to be of a taper shape with a thinned end, arranging the center of the end of the dielectric body at a symmetrical position of a non-rotational center, removing a part of the outer periphery of the protrusion of the dielectric body projected forward from the waveguide along the plane of the length direction of the waveguide and further making the dimension of the protrusion of the dielectric body smaller in the disposed direction of the primary feeds than in the direction normal to that, the distance between the dielectric bodies of the adjacently disposed primary feeds becomes large, so that the effect of suppressing mutual coupling phenomena is enhanced.

Furthermore, by cutting out the end of the dielectric body protruded from the waveguide, the length of the primary feed is shortened and, hence, the antenna can be further scaled down. Besides, excellent water repellence can be achieved by making the cut-out end of the dielectric body in a round shape.

DETAILED DESCRIPTION OF THE PREFERRED EMBODIMENT

FIGS. 3A to 13 represent preferred embodiments of the present invention. The basic structure of a radio wave lens antenna in accordance with the present invention is identical to that shown in FIG. 1 (there can be the one that employs a spherical Luneberg radio wave lens without a reflective plate) except a primary feed and a method for disposing two primary feeds closely. Thus, only the structures or the disposition methods of the primary feeds are described in the embodiments.

Figure 3A:
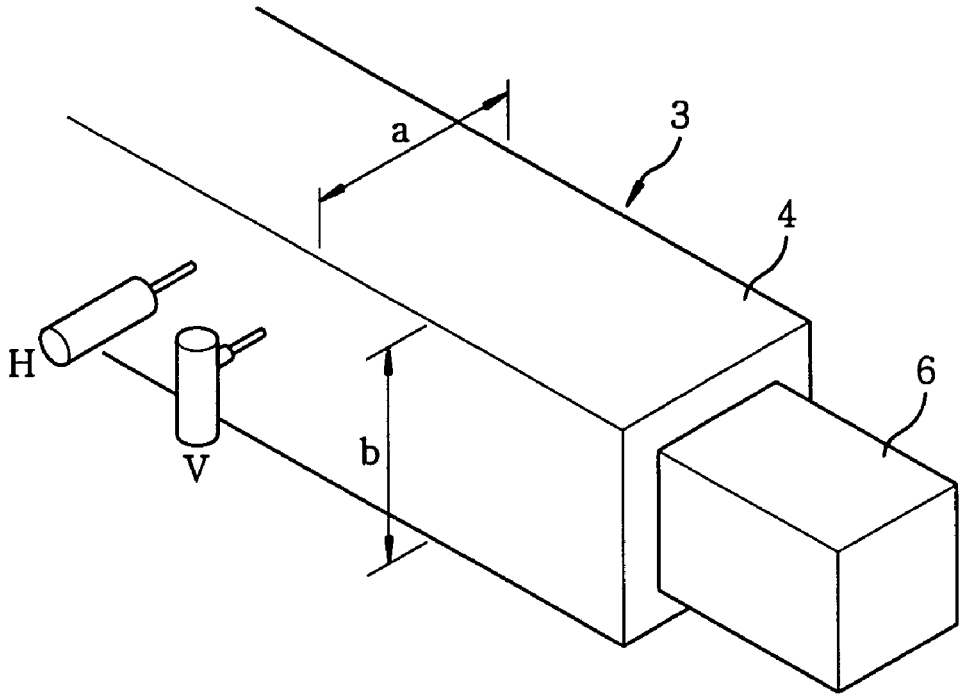
FIG. 3A provides a perspective view for describing main parts of an exemplary primary feed and FIG. 3B illustrates a cross section of a rectangular waveguide.
Figure 3B:
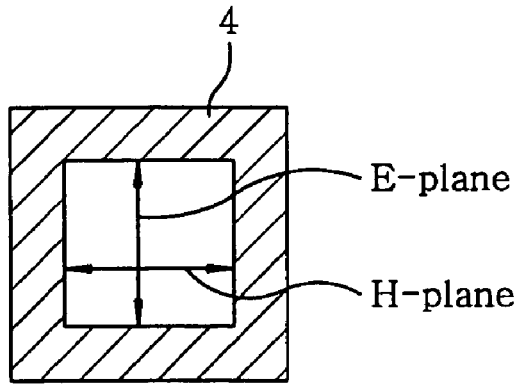

A primary feed 3 in FIG. 3A is constructed by loading a dielectric body 6 having a polygonal column shape at the end opening of a rectangular waveguide 4.

Figure 4:
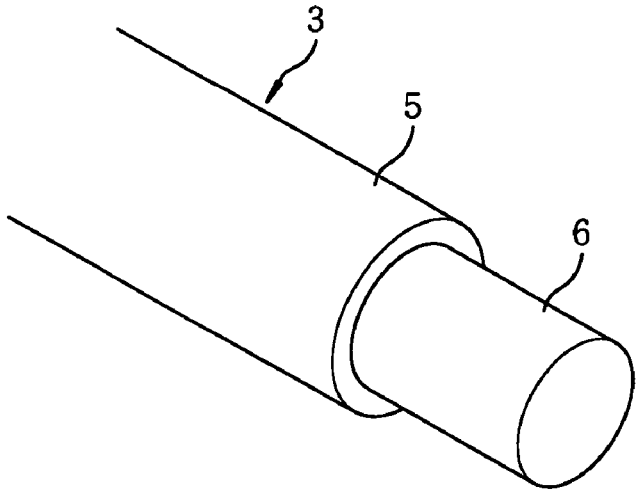
FIG. 4 sets forth a perspective view for describing main parts of another exemplary primary feed.
Figure 5:
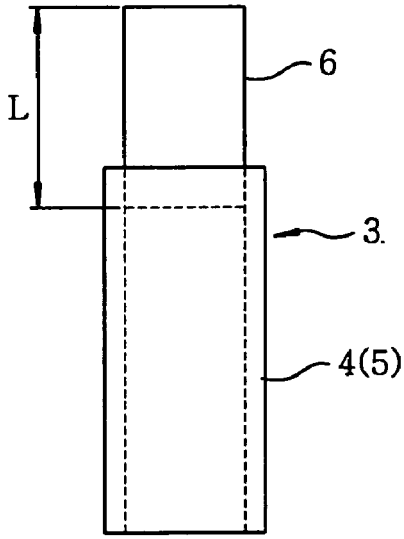
FIG. 5 shows a side view for describing main parts of the basic configuration of the primary feed.

On the other hand, a primary feed 3 in FIG. 4 is constructed by loading a dielectric body 6 of a circular column at the end opening of a circular waveguide 5 (it can be an elliptical waveguide).

A rectangular waveguide, in particular, a waveguide with a square cross section, offers better space efficiency and the best compactness of a primary feed. Nevertheless, depending on the performance of the loaded dielectric body, the primary feed 3 can be scaled down to a desired size by using a circular or an elliptical waveguide.

The material of the waveguides 4 and 5 can be a metal such as brass or aluminum or a die-casting with a high production yield. For the size of the waveguides 4 and 5, each side can be not greater than 18 mm (both a and b in FIG. 3A are not greater than 18 mm) in case of a rectangular waveguide for 12 GHz frequency band, for example. Therefore, even though the interval between primary feeds is 19.2 mm as described above, the primary feeds can be arranged at desired positions without interfering each other.

Further, the dielectric body 6 is preferably made of material of a relatively low dielectric constant and a small dielectric loss (tanδ), such as polyethylene.

The length of the dielectric body 6 (L in FIG. 5) is determined based on the full width at half maximum of the primary feed 3.

Figure 6:
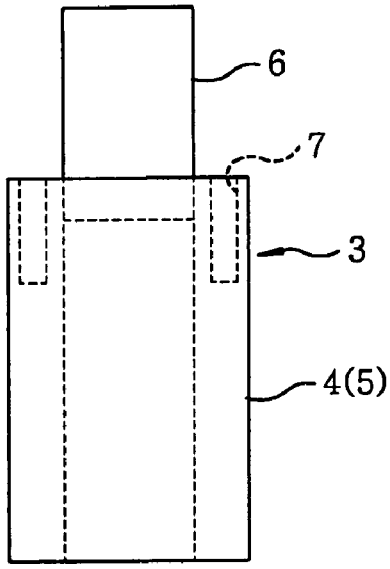
FIG. 6 provides a side view of the main parts of the primary feed further having a choke structure.

FIG. 6 represents a primary feed 3 which has a choke structure by making an annular groove 7 around the front surface of a waveguide 4. By using the choke structure as well, sidelobes of an individual primary feed can be effectively reduced and, sidelobe levels are also lowered. This choke structure is also useful in a primary feed employing waveguides other than the rectangular waveguide.

Figure 7:
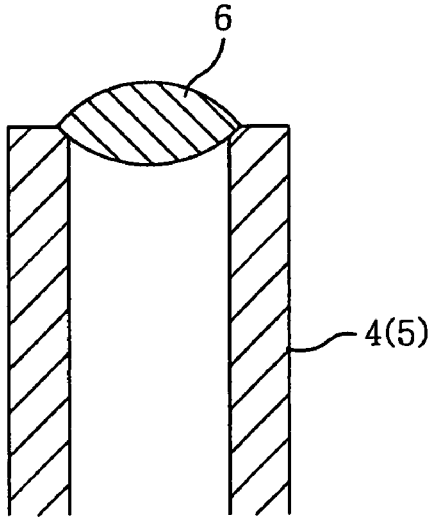
FIG. 7 describes a cross sectional view of the main parts of the primary feed loaded with a convex lens-shaped dielectric body.

The shape of the dielectric body 6 loaded to the waveguide is not limited to the column shape. FIG. 7 depicts a convex lens-shaped dielectric body 6 loaded at the end opening of a rectangular waveguide 4 (or a circular waveguide 5). The dielectric body 6 of such shape can be also used.

FIGS. 8A to 13 provide useful primary feeds when intervals between elements are small and there is a potential coupling problem.

Figure 8A:
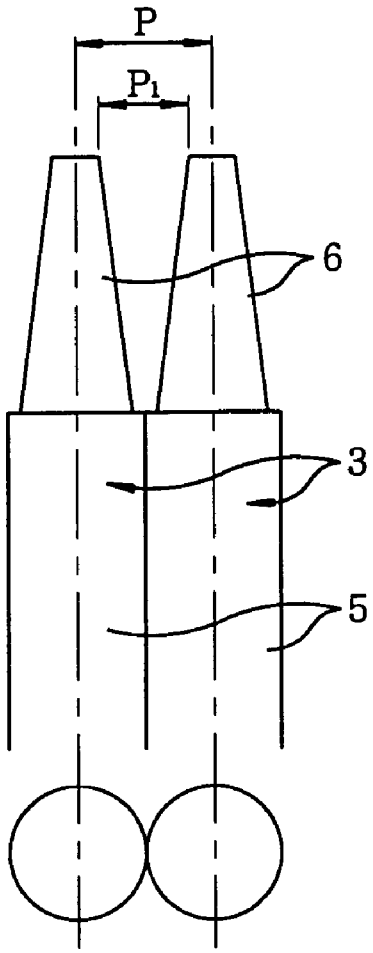
FIG. 8A depicts the disposition of two primary feeds employing circular waveguides and FIG. 8B is the disposition of two primary feeds employing rectangular waveguides.
Figure 8B:
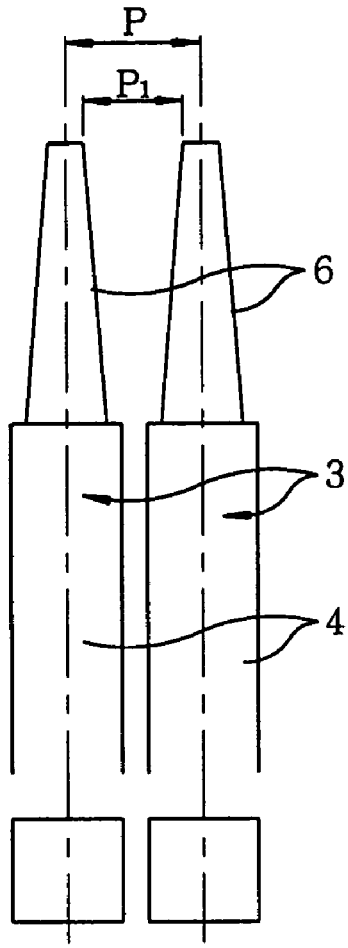
Figure 9A:
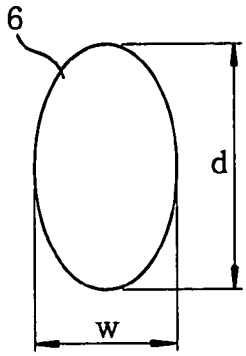
FIGS. 9A to 9F describe specific examples for the cross sectional shape of the protrusion of the dielectric body.
Figure 9B:
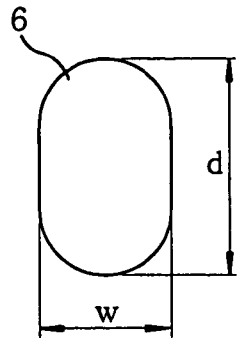
Figure 9C:
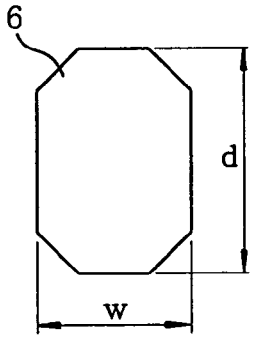
Figure 9D:
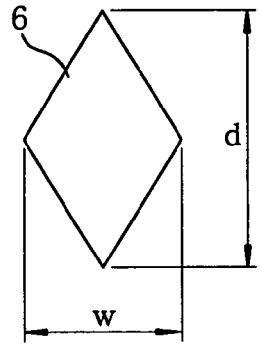
Figure 9E:
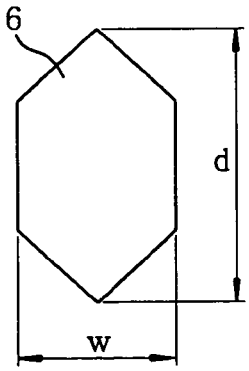
Figure 9F:
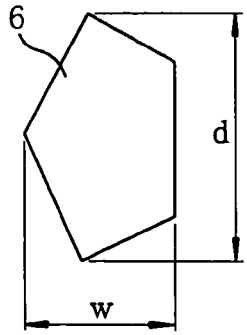

In FIGS. 8A and 8B, there are respectively shown two primary feeds 3 using circular waveguides 5 and using rectangular waveguides 4 which are arranged at the interval of P corresponding to the distance between geostationary satellites. The rectangular waveguide is advantageous in that it has a smaller tube size than the circular waveguide when adapted to a radio wave of a same frequency. Therefore, in case two primary feeds 3 are arranged at the interval of P by using the rectangular waveguides 4, the interval P1 between dielectric bodies 6 of both primary feeds is larger than the case by using the circular waveguides 5 and, thus, the coupling becomes weaker.

Each primary feed is arranged toward the center of the radio wave lens and thus the interval between the adjacent primary feeds becomes narrower when approaching closer to the ends of the elements. Therefore, it is preferable that the dielectric body 6 protruded from the waveguide is of a taper shape having a thinned end. FIGS. 9A to 9F illustrate exemplary cross sectional views of the protrusions. In all the exemplified protrusions, the width w (minor axis of an ellipse) is smaller than the dimension d in the direction normal to the width (major axis of an ellipse). Thus, by setting the direction of the dielectric body 6 in such a manner that the width direction coincides with the arranged direction of the primary feeds, a distance between the dielectric bodies of the adjacent primary feeds can be made larger.

FIG. 10 shows examples in which each of the protrusions of the dielectric bodies 6 from the waveguides has a taper shape having a thinned end. In FIG. 10A, the dielectric body 6 protruded from the waveguide is of an elliptical or polygonal cone shape while the apex of the cone is located at the center axis of the base of the cone. By cutting out the end of the protrusion as shown in FIG. 10B or 10C, the dimension of the primary feed along the axial direction is reduced. Thus, since the distance from the surface of the radio wave lens to the focal point becomes small, the size of the antenna can be further scaled down.

Figure 10A:
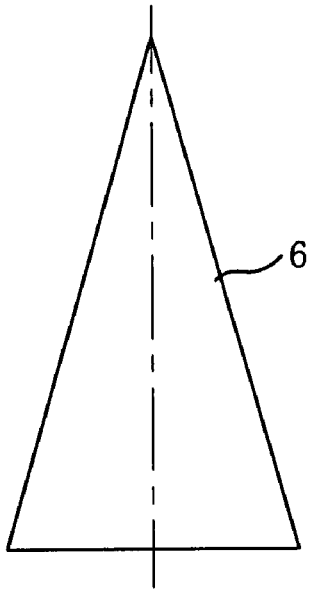
FIGS. 10A to 10D provide specific examples for the side shape of the protrusion of the dielectric body.
Figure 10B:
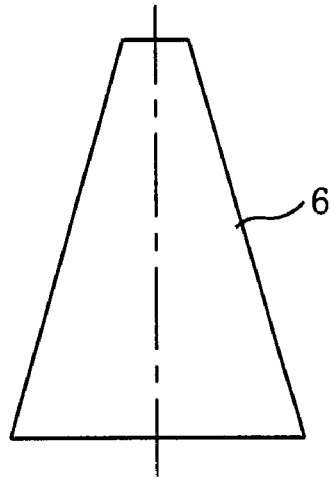
Figure 10C:
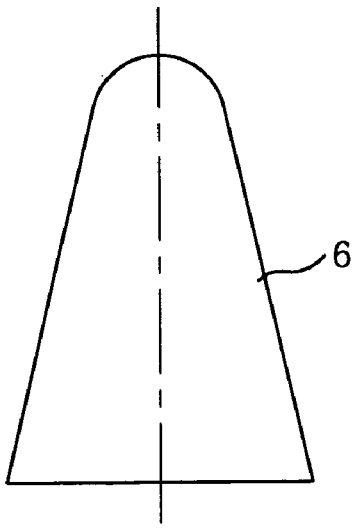

Further, considering water repellence in case of being wetted by rain, it is preferable that the cut-out end of the dielectric body 6 is of a round shape as shown in FIG. 10C rather than flat as shown in FIG. 10B.

Figure 10D:
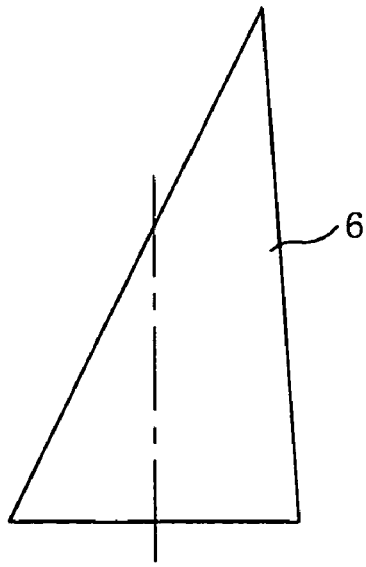
Figure 11:
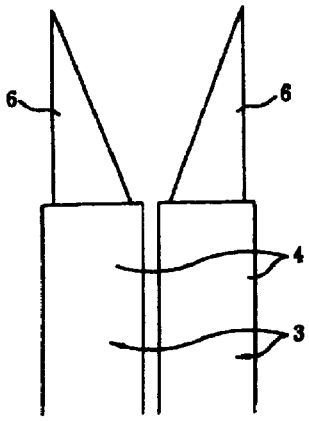
FIG. 11 shows an example of suppressing the coupling by using primary feeds loaded with dielectric bodies of a shape having a non-rotational symmetric end.

When the protrusion of the dielectric body 6 is of a cone-shape, the vertex is located off the center axis of the base of the cone as illustrated FIG. 10D. In the present invention, two primary feeds 3 each having the dielectric body 6 whose protrusion is of a non-rotational symmetrical shape as described above are disposed closely. If two primary feeds are disposed closely, mutual coupling phenomena occurs, resulting in the distortion of radio waves captured by the respective primary feeds. However, the distortion can be reduced by disposing the ends of the protrusions of the dielectric bodies 6 at off-centered positions in such manner that they are remotely spaced apart from each other as shown in FIG. 11.

Figure 12A:
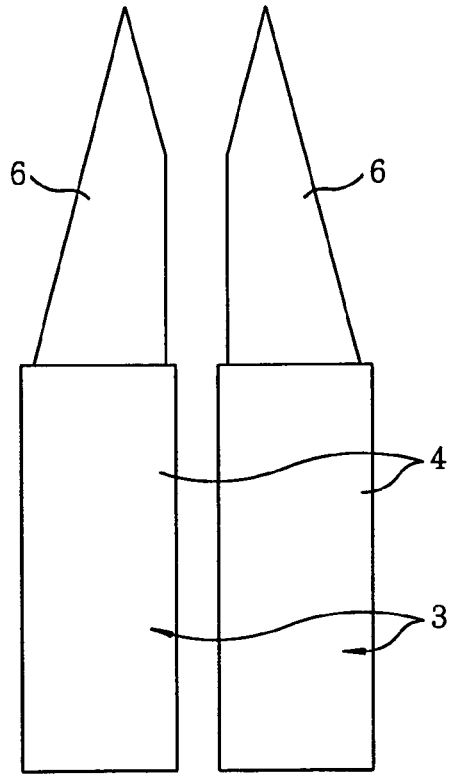
FIGS. 12A and 12B show an example for suppressing the coupling by cutting out a part of the dielectric body protruded from the waveguide.
Figure 12B:
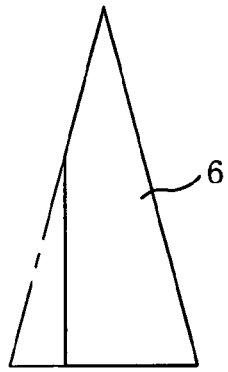

As illustrated in FIGS. 12A and 12B, a part of the outer periphery of the protrusion of the dielectric body 6 is cut out along the plane of a direction intersecting the cross section normal to the axis of the waveguide and such dielectric bodies 6 are loaded to the waveguides of the adjacent primary feeds in such a manner that the cut out surfaces of the outer peripheries face each other. The coupling can be also reduced in such a structure. Although the cut out surface of the outer periphery of the dielectric body 6 is shown to be perpendicular to the cross section normal to the axis, it need not be.

Figure 13:
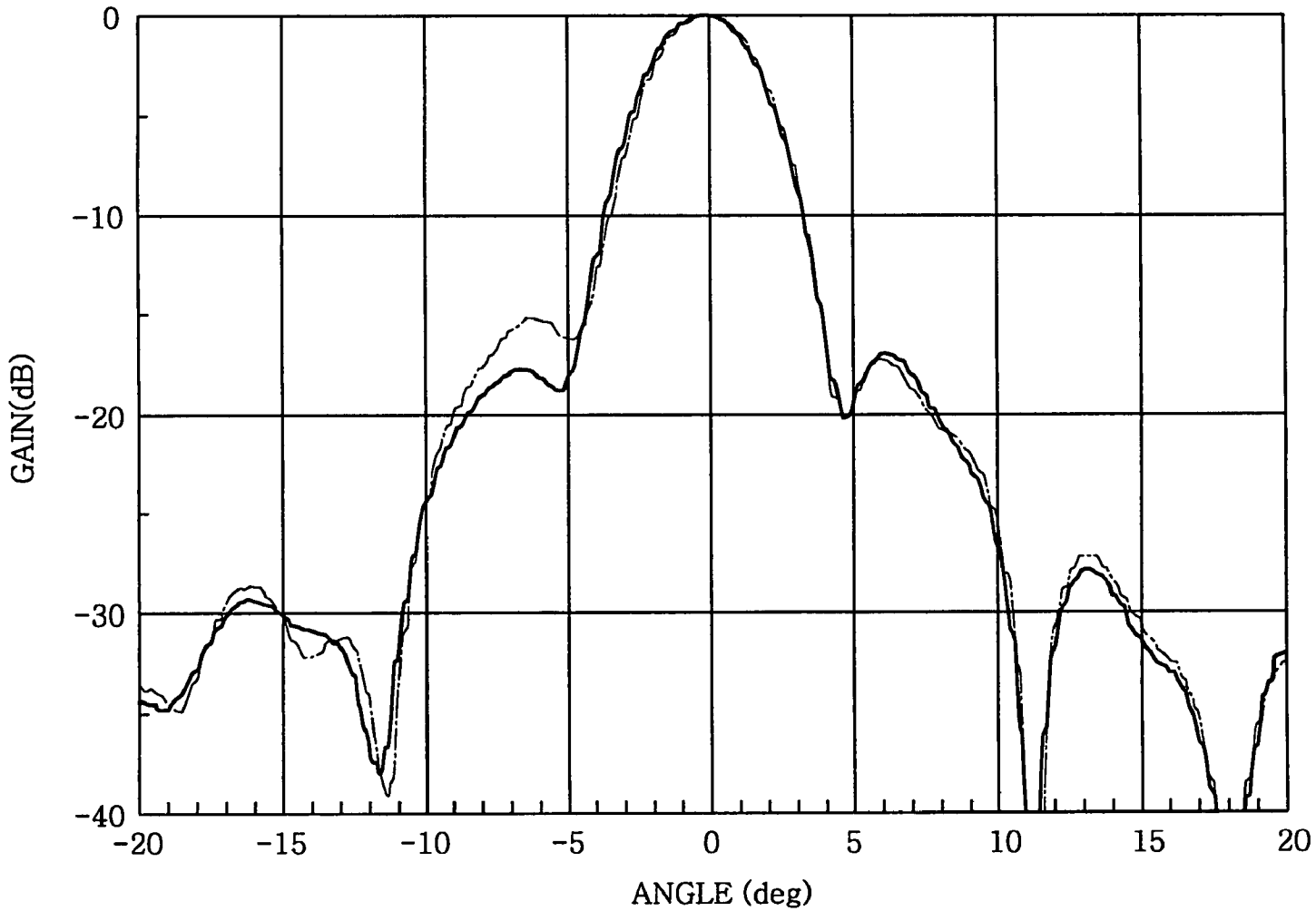
FIG. 13 presents antenna patterns for comparing weak coupling with strong coupling.
Figure 14:
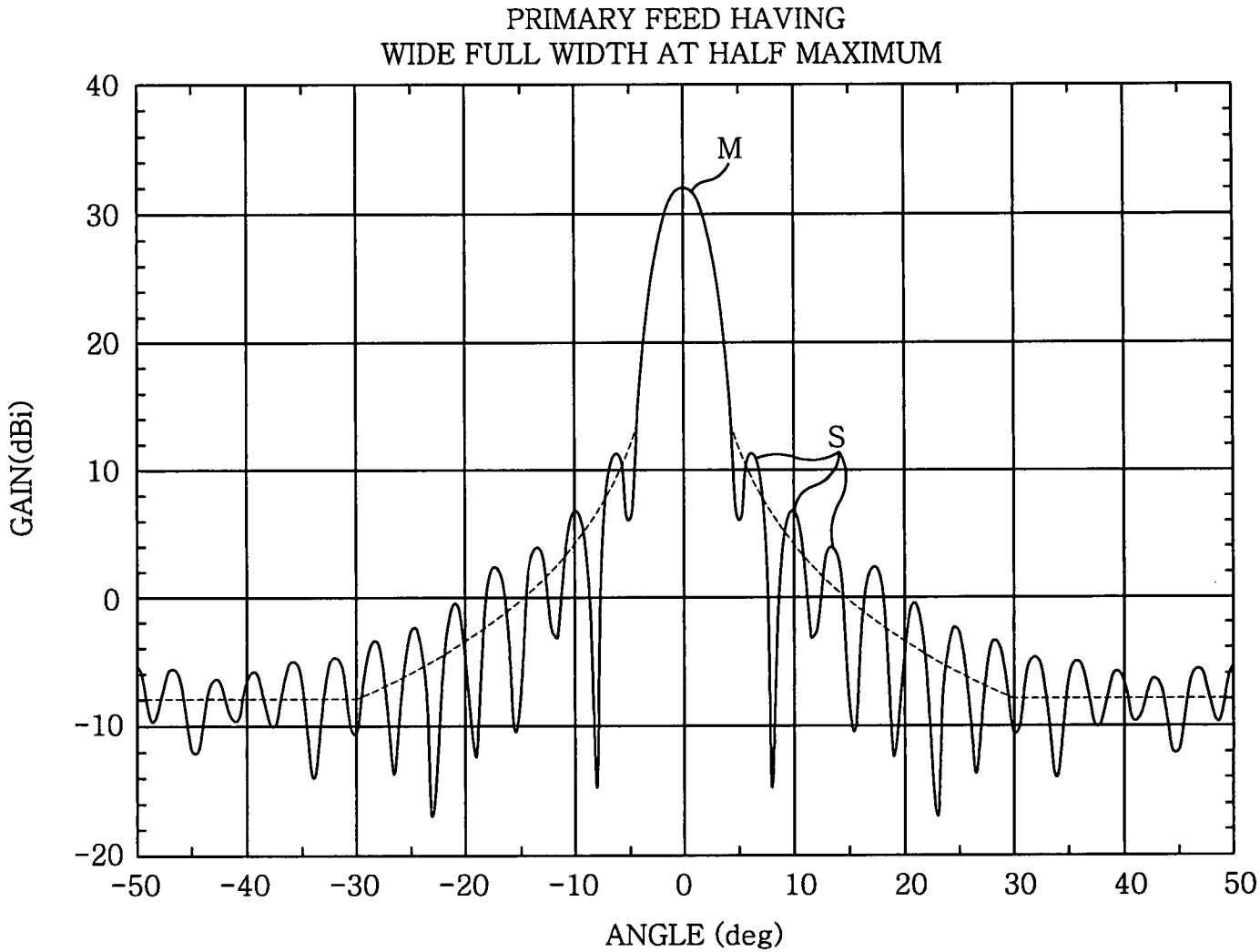
FIG. 14 shows an antenna pattern of an antenna with wide full width at half maximum.

In FIG. 13, the solid line and the dashed dotted line show antenna patterns with weak coupling and strong coupling, respectively. If the coupling is limited by using a rectangular waveguide and by tailoring the shape of a dielectric body, the distortion of a radio wave can be reduced and, therefore, communication sensitivity for the geostationary satellites can be improved.

Further, by combining the base portion of the waveguide where the dielectric body is loaded with a circuit board and mounting a low noise amplifier (LNA), a frequency conversion unit (converter) and the like on the circuit board, the primary feed 3 can be advantageously constructed as a low noise block down (LNB) for a satellite broadcasting antenna.

Figure 1:
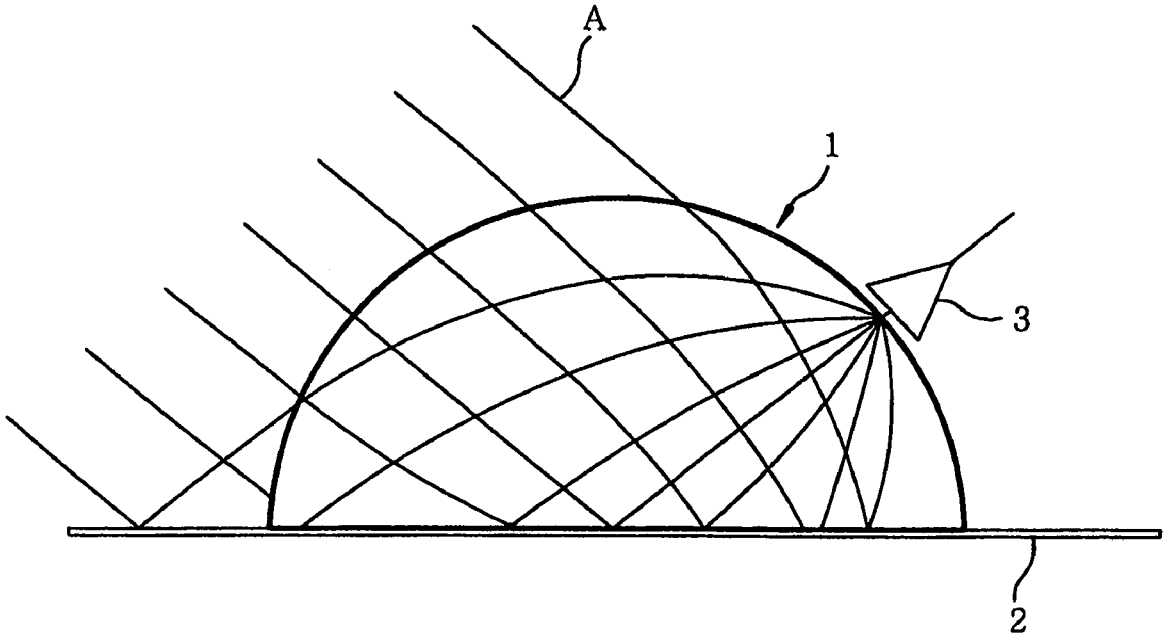
FIG. 1 (PRIOR ART)
FIG. 1 offers a schematic diagram of an antenna using a hemispherical Luneberg radio wave lens.
Figure 2A:
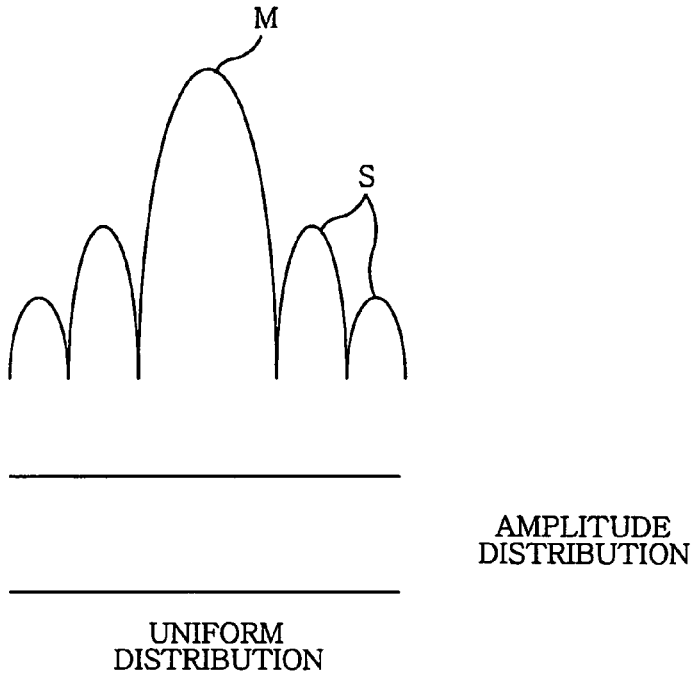
FIG. 2A shows an antenna pattern in case of a uniform amplitude distribution and FIG. 2B is an antenna pattern in case of a tapered amplitude distribution.
Figure 2B:
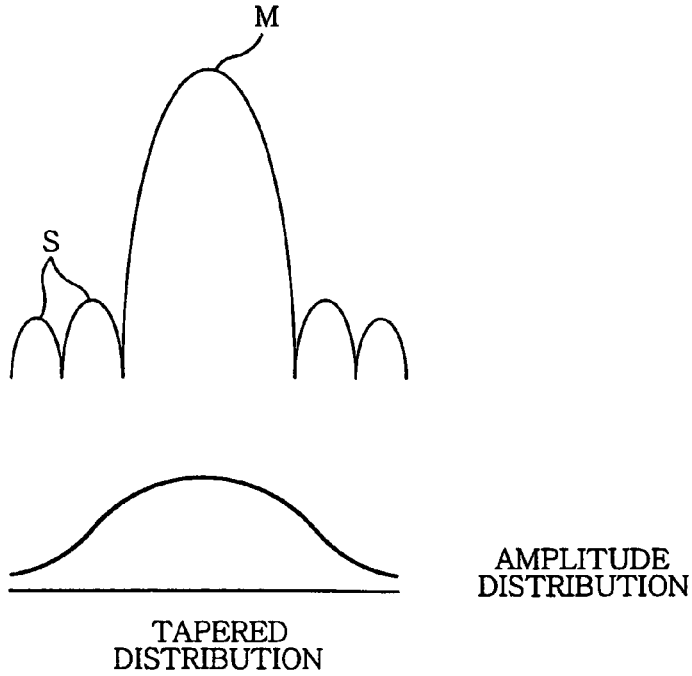

All of the above described primary feeds satisfy the following basic properties 1)–4) which are required in the element for the radio wave lens antenna of FIG. 1. Consequently, the requirement of the low sidelobe can be satisfied, which makes independent communications with adjacent satellites possible and which is a collective characteristic with a Luneberg radio wave lens:

1) The size is equal to or less than 0.8λ (λ: wavelength, for example, about 25 mm in case of 12.5 GHz frequency);
2) For example, the full width at half maximum of about 50 degrees can be realized;
3) It is a linearly polarized wave antenna for common use for both vertical (V) and horizontal (H) linearly polarized waves (if this condition is satisfied, it can be applied to the circularly polarized wave antenna); and
4) The antenna patterns of the E-plane and H-plane (see FIG. 3B) can be identical as much as possible.

Figure 15:
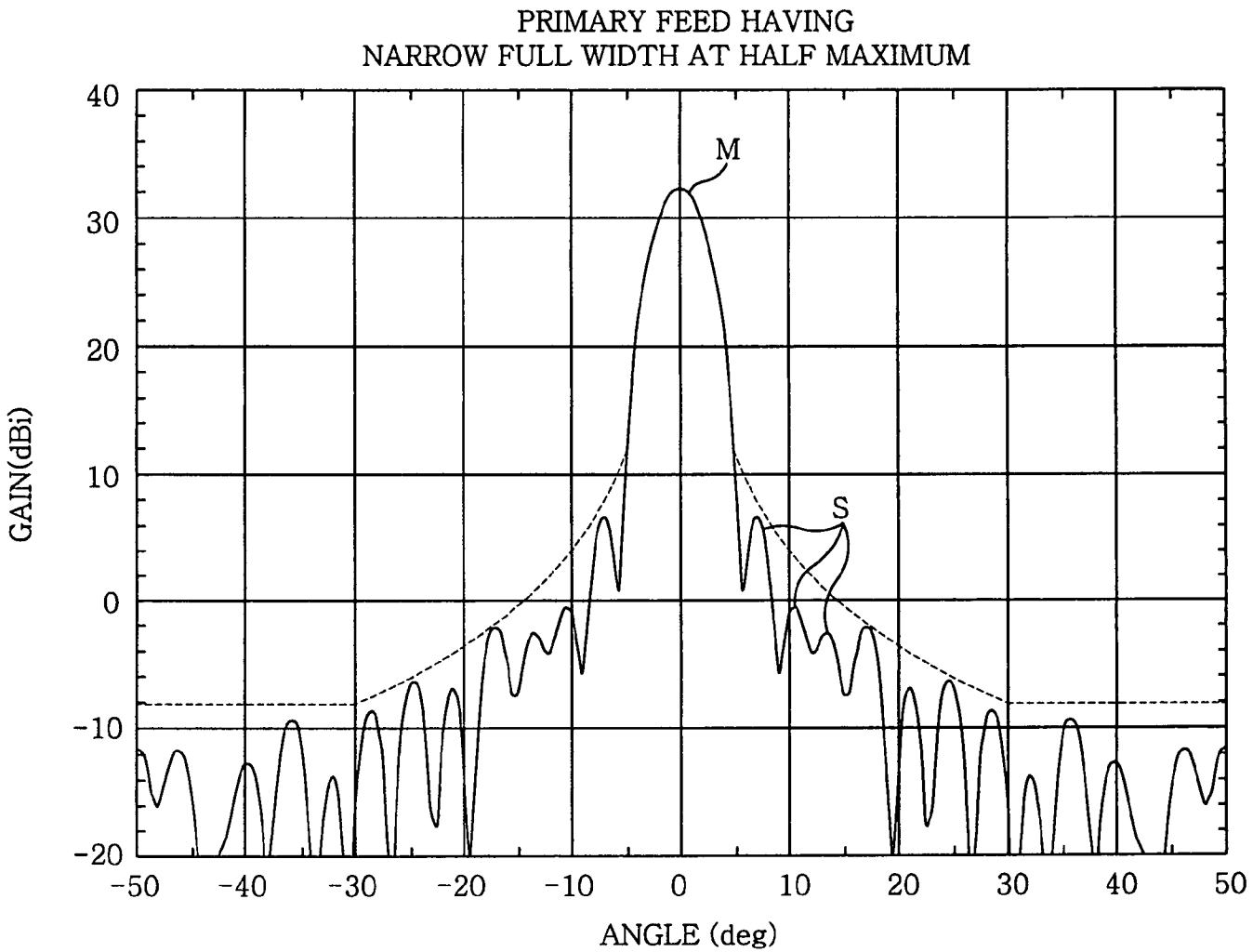
FIG. 15 describes an antenna pattern of an antenna in case of using a dielectric-loaded waveguide antenna as a primary feed.

FIG. 15 illustrates the effect of lowering the sidelobes in the antenna pattern of the lens antenna when the aforementioned dielectric-loaded waveguide antenna (which uses a rectangular waveguide) is employed as a primary feed 3 of the radio wave lens antenna in FIG. 1.

As shown, if a dielectric-loaded waveguide antenna featuring the present invention is used, the sidelobes S become smaller than the desired envelope (dotted line in the drawing) and, therefore, it is possible to independently communicate with the satellites spaced at small elongations (for example, an interval of 4.4 degrees).

Simultaneously, scaling down of the primary feed is achieved and spatial installation restriction of the primary feed is relaxed; and, thus, it is possible to communicate with a plurality of satellites.

What is claimed is:

1. A radio wave lens antenna comprising:

a hemispherical radio wave lens for focusing radio wave beams;

a reflective plate attached to a half-cut surface of the sphere of the radio wave lens for reflecting radio waves incoming from the sky or radiated toward targets; and primary feeds positioned at arbitrary radio wave focus points of the radio wave lens for transmitting or receiving the radio waves, wherein the primary feeds include at least one pair of primary feeds installed closely and each of the two closely disposed primary feeds includes a dielectric loaded waveguide antenna where a dielectric body is loaded at an end opening of a waveguide, a center of the end of the dielectric body being located off the extension of the waveguide's center axis and the centers of the ends of the dielectric bodies of the two closely disposed primary feeds being disposed at off-centered positions such that the centers are remotely spaced apart from each other.

2. The radio wave lens antenna of claim 1, wherein the dielectric-loaded waveguide antenna is a dielectric-loaded rectangular waveguide antenna where the dielectric body is loaded at the end opening of a rectangular waveguide.

3. The radio wave lens antenna of claim 1, wherein the dielectric body of the dielectric-loaded waveguide antenna is protruded forward from the waveguide and a protruded portion of the dielectric body is of a taper shape having a thinned end.

4. The radio wave lens antenna of claim 3, wherein an end of the dielectric body protruded from the waveguide is cut out such that the end of the dielectric body is of flat or a round shape.

5. The radio wave lens antenna of claim 3, wherein in a plane including a cross section of the protruded portion of the dielectric body protruded forward from the waveguide, a dimension of the protruded portion in a disposed direction of the two primary feeds is smaller than that in a direction normal to the disposed direction of the two primary feeds, the cross section of the protruded portion being normal to the waveguide's center axis.

6. The radio wave lens antenna of claim 5, wherein an end of the dielectric body protruded from the waveguide is cut out such that the end of the dielectric body is of flat or a round shape.

7. The radio wave lens antenna of claim 1, wherein the dielectric body is protruded forward from the waveguide and a part of an outer periphery of a protruded portion of the dielectric body is removed along a plane of a direction intersecting a cross section of the waveguide normal to the center axis thereof.

8. The radio wave lens antenna of claim 7, wherein in a plane including a cross section of the protruded portion of the dielectric body protruded forward from the waveguide, a dimension of the protruded portion in a disposed direction of the two primary feeds is smaller than that in a direction normal to the disposed direction of the two primary feeds, the cross section of the protruded portion being normal to the waveguide's center axis.

9. The radio wave lens antenna of claim 8, wherein an end of the dielectric body protruded from the waveguide is cut out such that the end of the dielectric body is of flat or a round shape.

10. The radio wave lens antenna of claim 7, wherein an end of the dielectric body protruded from the waveguide is cut out such that the end of the dielectric body is of flat or a round shape.

11. A radio wave lens antenna comprising:

a spherical radio wave lens for focusing radio wave beams; and primary feeds positioned at arbitrary radio wave focus points of the radio wave lens for transmitting or receiving the radio waves, wherein the primary feeds include at least one pair of primary feeds installed closely and each of the two closely disposed primary feeds includes a dielectric loaded waveguide antenna where a dielectric body is loaded at an end opening of a waveguide, a center of the end of the dielectric body being located off the extension of the waveguide's center axis and the centers of the ends of the dielectric bodies of the two closely disposed primary feeds being disposed at off-centered positions such that the centers are remotely spaced apart from each other.

12. The radio wave lens antenna of claim 11, wherein the dielectric-loaded waveguide antenna is a dielectric-loaded rectangular waveguide antenna where the dielectric body is loaded at the end opening of a rectangular waveguide.

13. The radio wave lens antenna of claim 11, wherein the dielectric body of the dielectric-loaded waveguide antenna is protruded forward from the waveguide and a protruded portion of the dielectric body is of a taper shape having a thinned end.

14. The radio wave lens antenna of claim 13, wherein an end of the dielectric body protruded from the waveguide is cut out such that the end of the dielectric body is of flat or a round shape.

15. The radio wave lens antenna of claim 13, wherein in a plane including a cross section of the protruded portion of the dielectric body protruded forward from the waveguide, a dimension of the protruded portion in a disposed direction of the two primary feeds is smaller than that in a direction normal to the disposed direction of the two primary feeds, the cross section of the protruded portion being normal to the waveguide's center axis.

16. The radio wave lens antenna of claim 15, wherein an end of the dielectric body protruded from the waveguide is cut out such that the end of the dielectric body is of flat or a round shape.

17. The radio wave lens antenna of claim 11, wherein the dielectric body is protruded forward from the waveguide and a part of an outer periphery of a protruded portion of the dielectric body is removed along a plane of a direction intersecting a cross section of the waveguide normal to the center axis thereof.

18. The radio wave lens antenna of claim 17, wherein in a plane including a cross section of the protruded portion of the dielectric body protruded forward from the waveguide, a dimension of the protruded portion in a disposed direction of the two primary feeds is smaller than that in a direction normal to the disposed direction of the two primary feeds, the cross section of the protruded portion being normal to the waveguide's center axis.

19. The radio wave lens antenna of claim 18, wherein an end of the dielectric body protruded from the waveguide is cut out such that the end of the dielectric body is of flat or a round shape.

20. The radio wave lens antenna of claim 17, wherein an end of the dielectric body protruded from the waveguide is cut out such that the end of the dielectric body is of flat or a round shape.

* * * * *